US005475898A

United States Patent [19]

Holdsworth

[11] Patent Number: 5,475,898

[45] Date of Patent: Dec. 19, 1995

[54] METHOD OF FIXING CARD CLOTHING TO CARRIER CYLINDER

[76] Inventor: William Holdsworth, Hill End Farm, Wall Nook Lane, Cumberworth Huddersfield, England

[21] Appl. No.: 405,764

[22] Filed: Mar. 16, 1995

Related U.S. Application Data

[63] Continuation of Ser. No. 150,093, Jan. 18, 1994, abandoned.

[30] Foreign Application Priority Data

May 25, 1991 [GB] United Kingdom ..... 9111373

[51] Int. Cl.[6] ..... D01G 15/92; D01G 19/10; D01H 4/32

[52] U.S. Cl. ..... 19/114; 29/895.21

[58] Field of Search ..... 19/54, 112, 114; 66/9 B; 29/467, 464, 466, 895.21, 895.211, 895.213, 895.23; 101/415.1

[56] References Cited

U.S. PATENT DOCUMENTS

| | | | |
|---|---|---|---|
| 761,470 | 5/1904 | Gessner | 19/112 |
| 1,084,786 | 1/1914 | Calderwood | 19/112 |
| 1,653,596 | 12/1927 | Arnold | 19/114 |
| 1,727,882 | 9/1929 | Hubbard | 101/415.1 X |
| 1,731,534 | 10/1929 | Karrer | 19/54 |
| 1,791,761 | 2/1931 | Larrabee | 101/415.1 X |
| 2,002,079 | 5/1935 | Dickie | 19/114 |
| 2,209,127 | 7/1940 | Lowe | 101/415.1 X |
| 2,437,050 | 3/1948 | Schulz | 29/118 |
| 2,489,791 | 11/1949 | Liles et al. | 154/54.5 |
| 2,775,199 | 12/1956 | Claff et al. | 101/415.1 |
| 3,145,464 | 8/1964 | Green | 29/464 |
| 3,234,694 | 2/1966 | Vosburg | 29/118 X |
| 3,290,729 | 12/1966 | Maynard | 19/114 |
| 3,430,561 | 3/1969 | Simmons | 101/415.1 |
| 3,449,811 | 6/1969 | De Ligt | 29/895.21 |
| 3,590,737 | 7/1971 | Stroud | 101/415.1 |
| 3,693,544 | 9/1972 | Trzyna | 101/415.1 X |
| 3,755,847 | 9/1973 | Liebscher | 101/415.1 X |
| 3,896,727 | 7/1975 | Ruckdeschel, Jr. | 101/415.1 |
| 3,947,922 | 4/1976 | Ibbotson | 19/114 |
| 4,100,006 | 7/1978 | Buckley | 19/114 X |
| 4,356,598 | 11/1982 | Graf | 19/114 |
| 4,378,737 | 4/1983 | Kirkpatrick | 101/415.1 |
| 4,408,371 | 10/1983 | Quay | 19/114 |
| 4,516,292 | 5/1985 | Quay | 19/114 X |
| 4,679,390 | 7/1987 | Stewart | 19/112 X |
| 5,003,793 | 4/1991 | Leins et al. | 19/114 X |
| 5,230,124 | 7/1993 | Booth | 19/114 X |

FOREIGN PATENT DOCUMENTS

| | | | |
|---|---|---|---|
| 0268417 | 5/1988 | European Pat. Off. . | |
| 395909 | 11/1990 | European Pat. Off. | 19/114 |
| 1067137 | 6/1954 | France . | |
| 2260637 | 5/1975 | France . | |
| 15632 | 4/1881 | Germany . | |
| 572689 | 3/1933 | Germany . | |
| 3133280 | 3/1983 | Germany . | |
| 3407392 | 4/1985 | Germany . | |
| 0546938 | 1/1979 | Japan . | |
| 59-112033 | 6/1984 | Japan . | |
| 97 | 11/1889 | United Kingdom | 19/112 |
| 368609 | 3/1932 | United Kingdom | 101/415.1 |
| 2114608 | 8/1983 | United Kingdom . | |
| 9008211 | 7/1990 | WIPO . | |

*Primary Examiner*—John J. Calvert
*Attorney, Agent, or Firm*—Merchant, Gould, Smith, Edell, Welter & Schmidt

[57] ABSTRACT

Card clothing including a strip of resilient material, wire carding teeth, and a carrier web is fixed onto the surface of a carrier cylinder by locating the ends of the carrier web in a slot in the cylinder and fitting them into a U-shaped clip which extends along the slot within the cylinder.

4 Claims, 4 Drawing Sheets

METHOD OF FIXING CARD CLOTHING TO CARRIER CYLINDER

This is a File Wrapper Continuation application of application Ser. No. 08/150,093, filed Jan. 18, 1994 now abandoned.

This invention relates to a method of fixing card clothing to a carrier cylinder or roll e.g. a doffer roll which forms part of a high pile fabric knitting machine, and to a card clothing assembly for securement to a carrier cylinder.

High pile fabric knitting machines usually comprise rotary knitting machines provided with a plurality of carding heads, constituting fibre transfer and feeding units, for supplying carded sliver fibres to the knitting needles. Usually, the knitting needles are mounted independently in a cylinder, which is rotatable relative to the several carding heads disposed at circumferentially spaced locations around the cylinder.

The carding heads for feeding carded sliver fibres to the needles of high pile fabric knitting machines are constituted of at least one pair of rotatable sliver feed rolls—usually having wire-covered or fluted peripheries—a rotatable wire-covered main cylinder and a rotatable wire-covered doffer. The sliver feed rolls draw sliver in rope form from a source of supply, and deliver the fibres in sheet form, to the main cylinder. The latter, acting as a transfer medium, conveys the sheet of sliver fibres to the doffer which, in turn, feeds the fibres to the needles of the knitting machine. In order to properly transfer the fibres during their delivery to the needles, the main cylinder is caused to rotate faster than the sliver feed rolls, and the doffer is caused to rotate faster than the main cylinder.

In clothing the doffer, it has been the practice for very many years to wrap an elongated, narrow strip of wire-covered card clothing helically about the periphery surface of the doffer roll. Each end of the helically wound strip is secured to the rim of the doffer roll by fastening means, such as a threaded bolt passing through the rim and being secured thereto by a threaded nut. The helical wrapping of the doffer is time consuming and difficult. No matter how careful the winding, empty spaces or voids often occur in the card clothing because such defects usually are inherent in helical winding. Further, in the helical winding of the elongated strips of card clothing, the spirals often depart from a true helix, the result of which is to create undesirable lines or shadows in the high pile of the fabric being knit. Such lines or shadows are detrimental to the quality of the fabric.

A further disadvantage of existing types of card clothing is that the bases of the card clothing teeth which are anchored in the foundation of the clothing are liable to make indentations in the surface of the roll over a period of time, unless a protective tape covering is first stuck onto the surface of the roller, which is a further process step in existing application of card clothing to doffer rolls, which is a further labour cost, and a further source of possible imperfections in the application of the card clothing to the doffer roll.

The present invention has therefore been developed with a view to providing an improved means for mounting on a carrier cylinder or roll e.g. a doffer roll, a single elongate piece of card clothing which is rectangular as seen in plan and which can be applied around the cylinder so as to bring the ends of the piece into abutment with each other and thereby to form a substantially uniform distribution of wire covered clothing on the outer periphery of the cylinder.

According to one aspect of the invention there is provided a method of fixing card clothing to the surface of a carrier cylinder having a slot in its outer periphery said card clothing comprising an elongate strip of resilient material having opposed ends which abut one another when the clothing is applied around the cylinder, wire carding teeth carried by said strip of resilient material and projecting from one side thereof so as to form a substantially uniform distribution of carding teeth throughout the outer periphery of the cylinder, and an elongate carrier web secured to said elongate strip of resilient material and having opposed ends which each project longitudinally beyond a respective end of the strip, and said method comprising:

forming the card clothing into a closed loop with the opposed ends of the elongate strip abutting each other, and the opposed ends of the carried web projecting inwardly of the loop and alongside one another;

fitting the opposed ends of the carrier web into an elongate U-shaped clip which extends along at least part of the opposed ends; and, fitting the closed loop of card clothing onto the outer periphery of the cylinder following presentation of the leading end of the clip to the entrance to the slot in the cylinder and then pushing the loop of clothing on to the cylinder simultaneously with advancement of the clip along the slot.

During the fitting of the card clothing on the cylinder, the clip slides along the slot and the fit between the opposed walls of the slot and the opposed limbs of the clip is such as to provide a slidable interengagement and also a tendency to exert an inward force on the limbs of the clip towards each other in order to further tighten the grip exerted on the opposed ends of the carrier web by the clip. This results in a very tight securement of the card clothing on the cylinder once the assembly is completed, and which is achieved in a simple and rapid manner.

This invention therefore enables carrier cylinders, such as doffer rolls to be "clothed" much more quickly than with techniques employed with known arrangements of card clothing.

To facilitate the application of the loop of card clothing onto the cylindrical surface of the carrier cylinder, which is preferably a doffer roll, a frusto conical guide may be used having a slot to be lined-up with the slot in the carrier cylinder, and having a maximum diameter corresponding substantially with the diameter of the cylindrical surface of the carrier cylinder, so that a loop of card clothing can be initially fitted on the conical guide, with the clip fitting in the slot in the guide, and then the loop of card clothing is pushed in a direction towards the carrier cylinder which causes the loop to expand circumferentially (which is permitted by extension of the elongate strip of resilient material to a limited extent), and then can be transferred by a sliding movement easily onto the cylinder surface of the carrier cylinder. The clip continues its movement into the slot of a carrier cylinder, and once the card clothing has been fully pushed onto the carrier cylinder, a tight fit will be maintained by reason of the pre-tension in the strip of resilient material caused by the circumferential expansion of the loop as it travels along the frusto conical guide.

The use of this frusto conical guide provides for a very simplified procedure, and which can be carried out quickly and reliably, in the assembly of card clothing on the carrier cylinder.

According to a further aspect of the invention, there is provided card clothing as defined above for use in the method of the invention.

The invention will now be described in detail, by way of example only, with reference to a preferred embodiment as shown in the accompanying drawings, in which.

Figure 1:
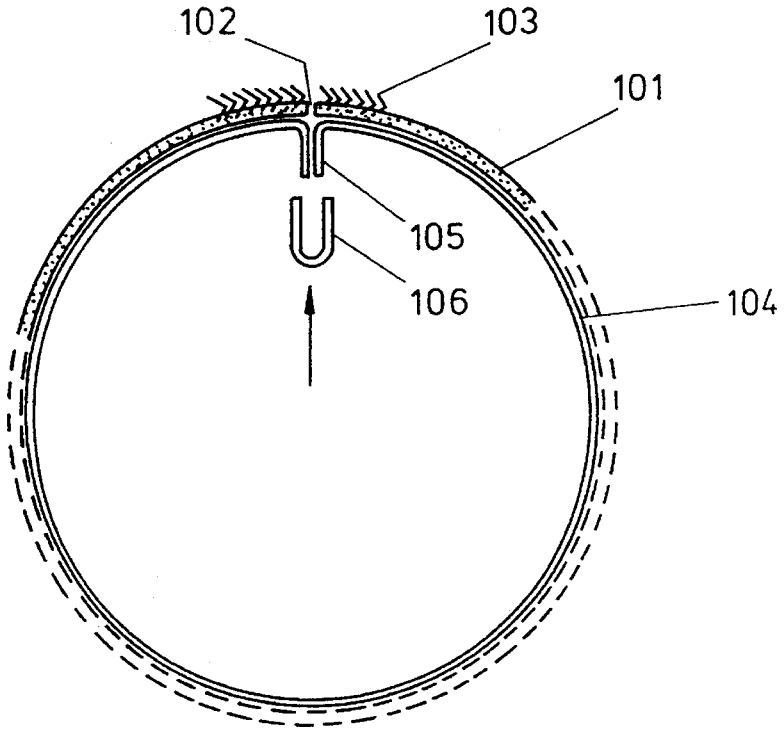
FIG. 1 is a schematic end view of a closed loop of card clothing for use in a method according to the invention of fixing card clothing to the surface of a carrier roll.
Figure 2:
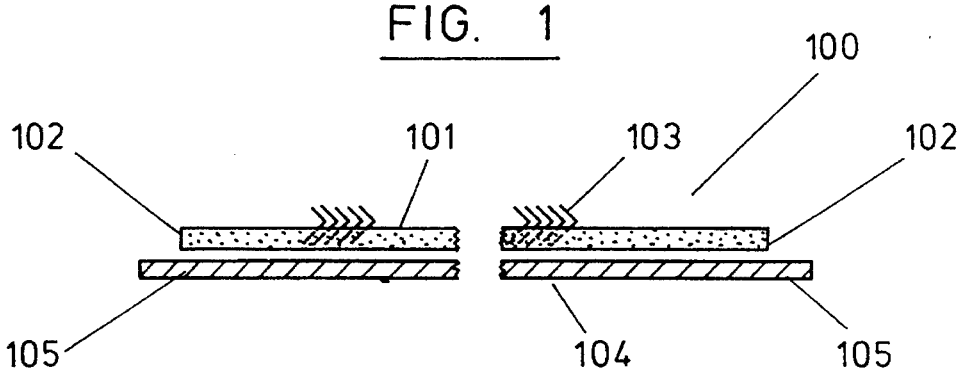
FIG. 2 is a schematic side view of the card clothing in the form of a rectangular strip prior to formation into the loop shown in FIG. 1.
Figure 3:
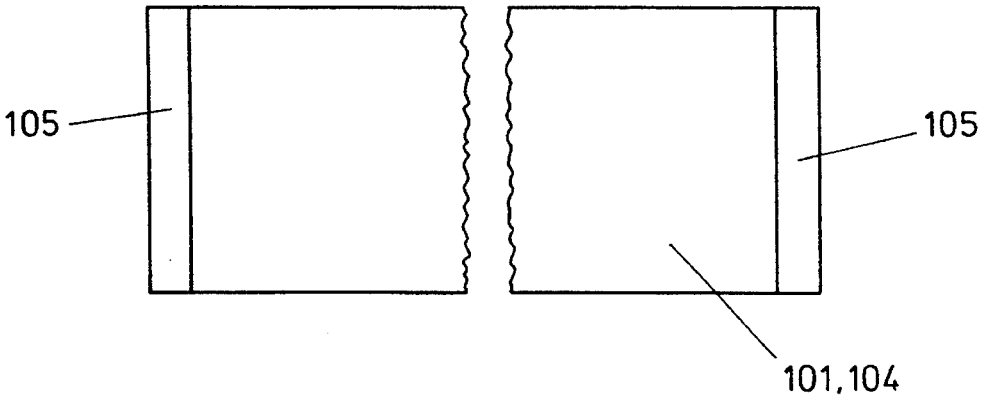
FIG. 3 is a plan view corresponding to FIG. 2.

Referring first to FIGS. 1 to 3 of the drawings, there is shown an elongate piece of card clothing which is designated generally by reference 100, and which is rectangularly, as seen in plan, and which comprises an elongate strip 101 of resilient material having opposed ends 102 which abut on another when the clothing is wrapped around the cylindrical surface of a carrier cylinder. FIG. 1 shows the ends 102 in abutment, after the formation of the flat strip shown in FIGS. 2 and 3 into a circular loop.

Wire carding teeth 103 are carried by the resilient strip 101 and project from one side thereof so as to be able to form a substantially uniform distribution of carding teeth throughout the outer periphery of the cylinder when the loop of card clothing is applied to the cylinder.

An elongate carrier web 104 is secured to the resilient strip 101, and is made of plies of textile material. Not only does the web 104 comprise a carrier or foundation for the card clothing, but it also serves to prevent contact between the base of the carding teeth 103 coming into contact with the metal surface of the carrier cylinder, which would otherwise give rise to indentations and abrasion over a period of time.

The carrier web 104 is longer than the strip 101, and therefore has opposed ends 105 which each project longitudinally beyond the respective end 102 of the strip 101. These projecting ends 105 can be folded so as to project inwardly of the looped form of the card clothing shown in FIG. 1, and also extend alongside one another.

The novel construction of card clothing described above with reference to FIGS. 1 to 3 can be applied in a novel technique to the surface of a carrier cylinder, such as a doffer roll. This technique will now be described with reference to FIGS. 4 and 5. After formation of the card clothing 100 into a closed loop as shown in FIG. 1, the projecting ends 105 of the carrier web 104 are fitted into an elongate U-shaped clip 106 which extends along at least part of the length of the ends 105, and preferably extends throughout the length of the ends 105 i.e. throughout the width of the piece of card clothing as shown in FIG. 3. This fitting of the ends 105 into the clip 106 can take place in any convenient way, and is shown schematically by an arrow in FIG. 1 by way of example only. Evidently, the clip 106 and the ends 105 could be fitted into one another by relative longitudinal sliding movement. The closed loop of card clothing can then be fitted onto the cylindrical outer periphery of a carrier cylinder, which in the illustrated arrangement comprises a doffer roll 107 having a cylindrical surface 108. An axially extending slot 109 (see FIG. 5) is formed in the cylindrical wall of the roll 107, and this serves to receive the clip 106 and the carrier web ends 105 trapped between the limbs of the clip 106.

The doffer roll 107 can be of standard design for use as part of a high pile fabric knitting machine, and the only modification to this standard design which is required to carry out the method of the invention is to form the axially extending slot 109 in the periphery of the roll.

To assemble the looped card clothing on the surface 108, it is necessary to present the leading end of the clip 106 to the entrance to the slot 109, and then the loop of clothing is pushed onto the surface 108 simultaneously with advancing of the clip 106 along the slot 109 until the clip end reaches circular end face 110 of the roll 107.

During the fitting of the loop of card clothing on the surface 108, the clip 106 slides along the slot 109 and the fit between the opposed walls 111 of the slot 109 and the opposed limbs of the clip 106 is such as to provide a slidable interengagement, and also an inward pinching action on the limbs which further tightens the grip exerted on the opposed ends 105 of the carrier web 105 by the clip 106. This results in a very tight securement of the loop of card clothing on the cylindrical surface 108 once the assembly is completed, and which can be carried out in a simple and rapid manner.

To facilitate the application of the loop of card clothing onto the cylindrical surface 108, a frusto conical guide 112 may be used, having a maximum diameter 113 which corresponds substantially with the diameter of the cylindrical surface 108, and also having an axial slot (not shown in FIG. 4) which can be lined-up with the slot 109, so that the looped card clothing can be advanced over the surface of the guide 112, with the clip 106 and the ends 105 being guided by the slot in the guide 112, and during this movement the loop can expand circumferentially as it is pushed towards the roll 107, which is permitted by extension of the elongate strip 101. Upon suitable circumferential expansion of the looped card clothing, it can then move smoothly from the frusto conical guide 112 and onto the cylindrical surface 108, and with the clip 106 entering smoothly into the slot 109 in the cylindrical wall of the roll 107.

The U-shaped elongate clip 106 therefore forms a simple and yet very reliable means for holding the projecting ends 105 of the looped card clothing assembly, and which can be quickly and easily slid into the slot in the carrier cylinder.

The invention therefore provides a much simplified means of assembly of card clothing on a roll, such as a doffer roll, resulting in substantial saving of labour costs. Also, by this simple modification of existing designs of doffer roll, the card clothing can be easily assembled. Further, this is a significant commercial advantage to manufacturers and users of knitting machines.

High pile fabric knitting machines have many uses, one of which comprises the formation of "fur fabric" e.g. of the type used to form the covering of furry toy animals (teddy bears), and the invention will be a particular advantage in these uses of knitting machines.

Figure 4:
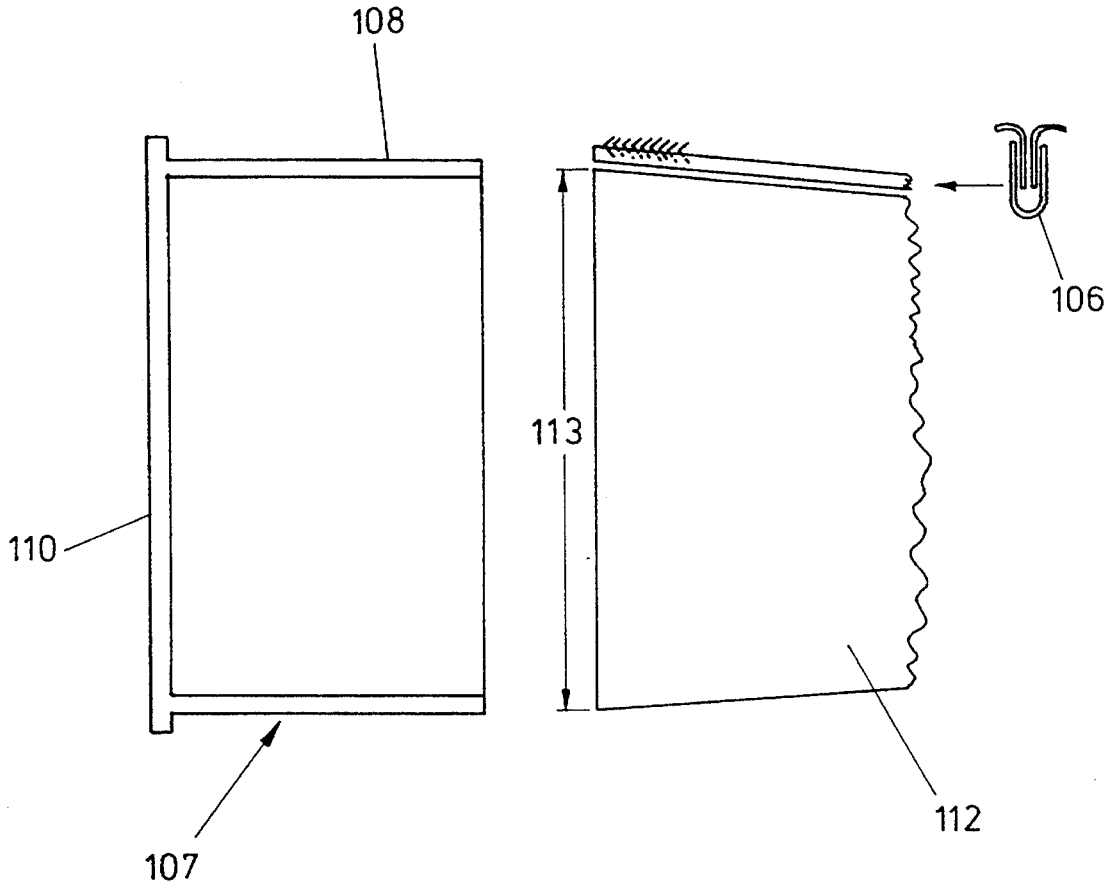
FIG. 4 is a schematic side view illustrating the manner by which the loop of card clothing can be guided onto the cylindrical surface of the carrier roll.
Figure 5:
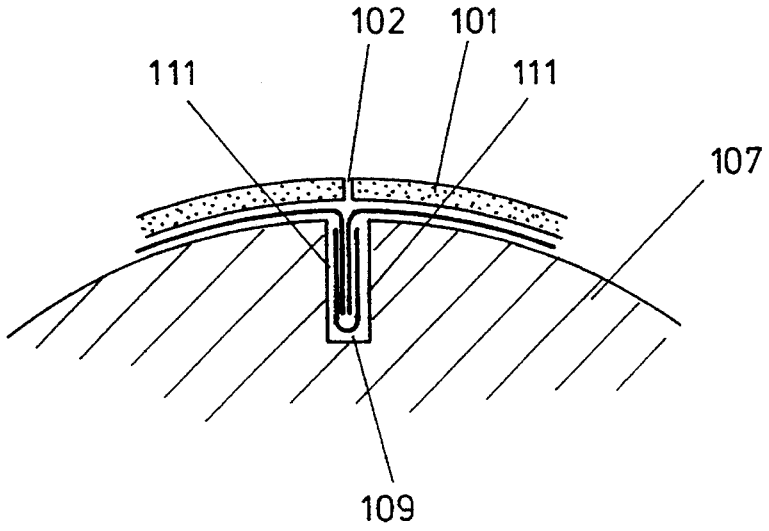
FIG. 5 is a schematic detail end view showing the mean by which the loop of card clothing is anchored tightly in position on the outer periphery of the carrier cylinder.
Figure 6:
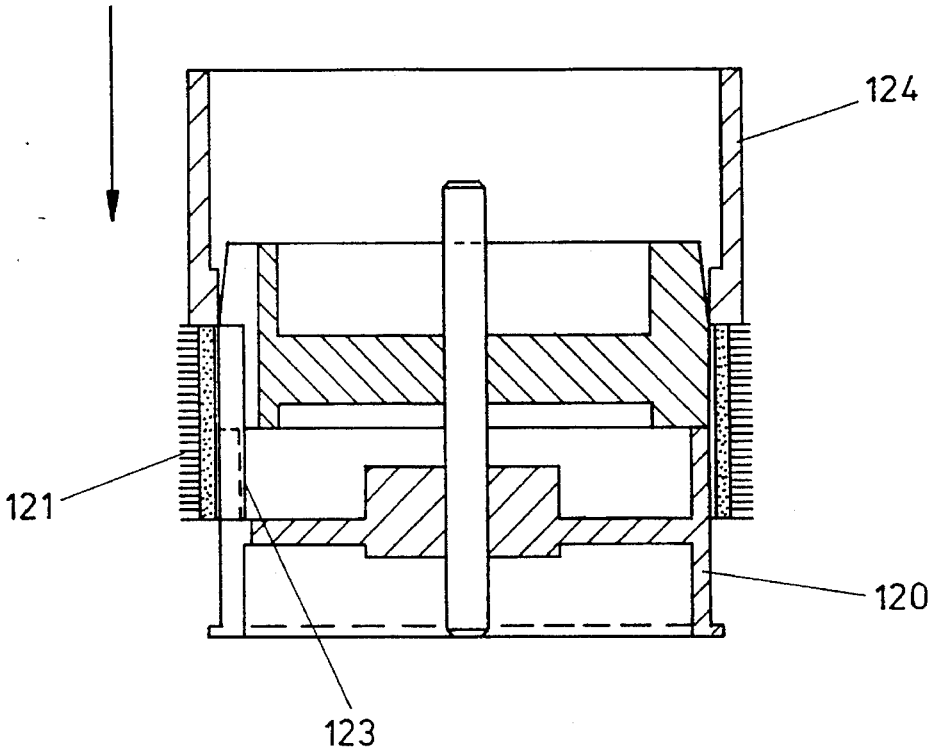
FIG. 6 is a sectional view showing in more detail a preferred arrangement for carrying out the method of assembly shown schematically in FIG. 4.
Figure 7:
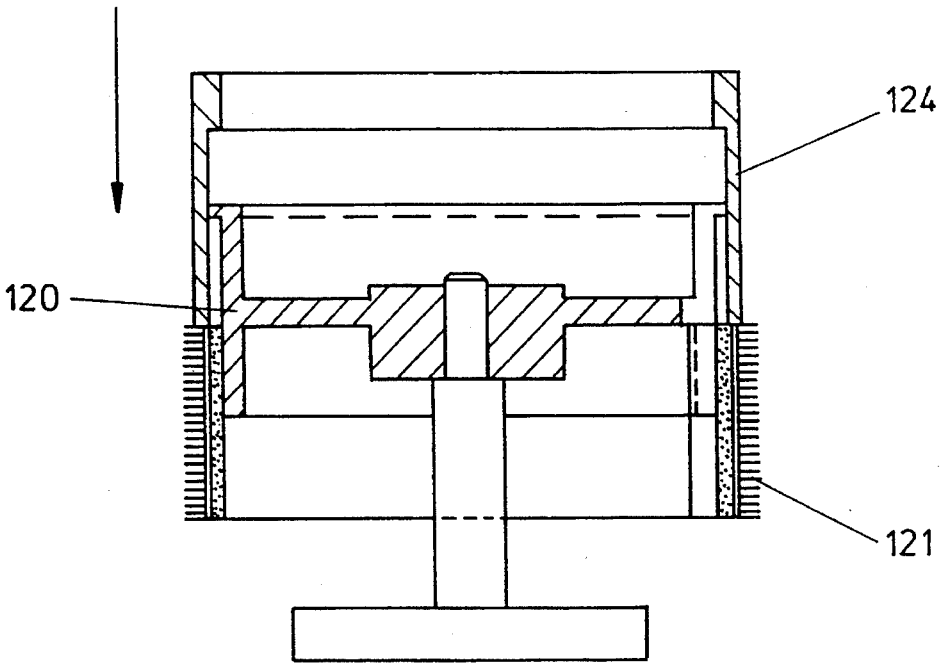
FIG. 7 is a similar view to FIG. 6, but showing the arrangement being used for dis-assembly.
Figure 8:
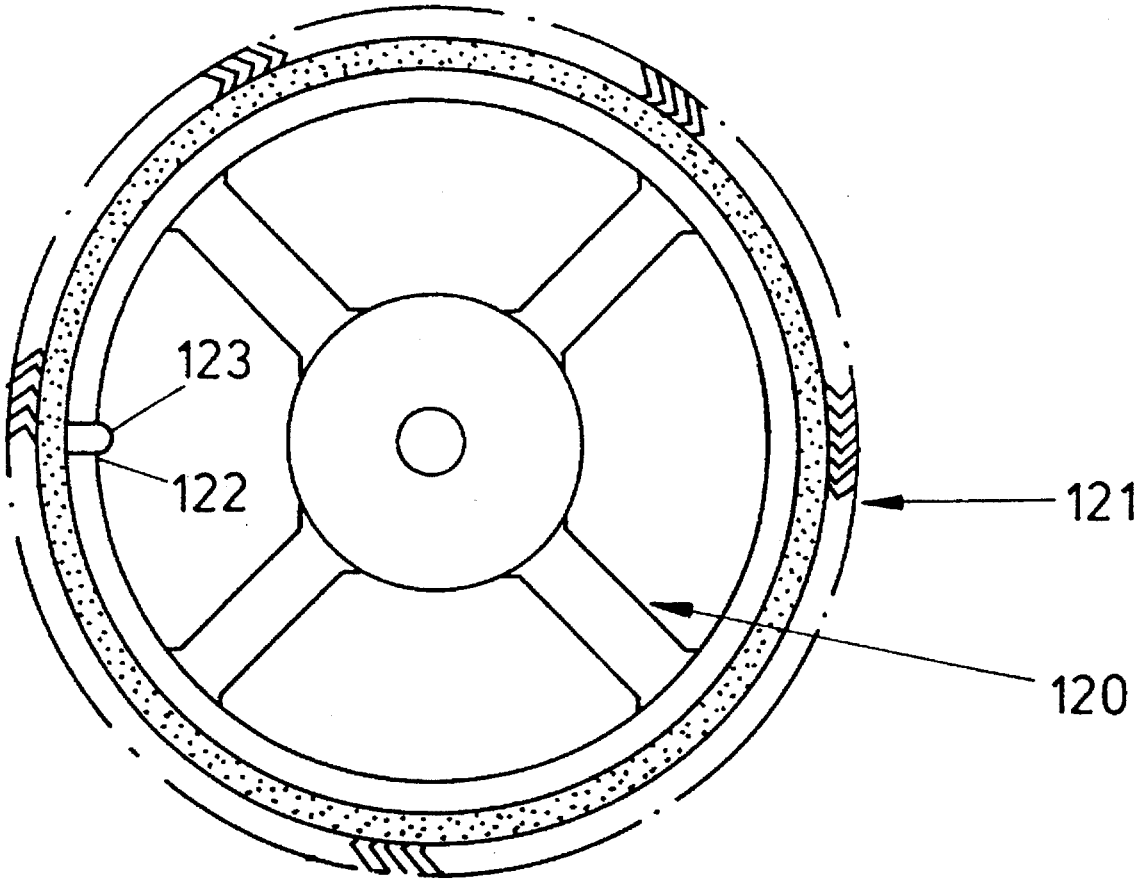
FIG. 8 is an end view of the card clothing assembled on a cylindrical carrier.

FIG. 1 to 5 are schematic illustrations of examples of the invention, and in particular FIGS. 4 and 5 show a preferred method of assembly of card clothing on a cylindrical carrier. Reference will now be made to FIGS. 6 to 8, which show practical constructions of means for carrying out the method of assembly steps shown schematically in FIGS. 4 and 5.

Referring first to FIGS. 6 and 7, a cylindrical carrier in the form of a knitting roller designated by reference 120 has a card clothing ring 121 arranged around its periphery, and which has its free projecting ends (not shown in detail), but equivalent to projecting ends 105 shown in FIG. 2, received in an axially extending slot 122 in the periphery of roller 120, and which are retained in this position by means of retaining clip 123.

FIG. 6 shows use of a mounting sleeve 124 which is used in order to slide card clothing ring 121 and retaining clip 123 axially onto the outer periphery of knitting roller 120, in generally similar manner to that described above with reference to FIG. 4. FIG. 7 shows use of the same components, in order to is assemble the card clothing ring.

FIG. 8 is an end view of the card clothing ring assembled around the outer periphery of knitting roller 120.

I claim:

1. A method of fixing card clothing onto a carrier cylinder which has a slot in an outer surface, the card clothing comprising: (i) an elongate strip of resilient material having opposed ends which abut one another when the card clothing is wrapped around the carrier cylinder; (ii) wire carding teeth carried by the elongate strip of resilient material, and projecting from one side thereof so as to form a substantially uniform distribution of carding teeth throughout the outer surface of the carrier cylinder; and (iii) an elongate formable into a closed loop carrier web secured to the elongate strip and having opposed ends which each project longitudinally beyond a respective end of the elongate strip, the method comprising the steps of:

forming the card clothing into a closed loop with the opposed ends of the elongate strip of resilient material abutting one another and the opposed ends of the carrier web projecting inwardly of the closed loop alongside one another, the carrier web being formable so as to be wrapped around the carrier cylinder;

fitting the opposed ends of the carrier web into an elongate U-shaped clip which is defined when viewed in cross-section by a pair of leg portions and a base portion from which the leg portions depend, the ends of the carrier web being received between and gripped by the leg portions along at least part of a length of the ends; and locating an end of the elongate U-shaped clip in the slot in the cylinder at one end of the slot and sliding (i) the clip along the slot so that the base portion extends along the slot, and (ii) the closed loop of the card clothing onto the outer surface of the carrier cylinder, the card clothing being fixed onto the carrier cylinder by means of clamping the ends of the carrier web by means of the elongate U-shaped clip.

2. A method as claimed in claim 1, wherein a guide is used to apply the closed loop of the card clothing onto the surface of the carrier cylinder, the guide having a guide slot formed in the guide and a diameter which corresponds approximately to a diameter of a cylindrical surface of the carrier cylinder, the method further comprising:

fitting a loop of card clothing initially onto the guide with the elongate U-shaped clip located in the guide slot;

locating the guide relative to the carrier cylinder so that the guide slot and the slot in the cylinder are aligned; and sliding the closed loop of the card clothing from the guide onto the carrier cylinder.

3. A method as claimed in claim 2, wherein the guide is frusto-conical, a maximum diameter of the guide corresponding approximately to the diameter of the carrier cylinder and the sliding step of the method involving causing the closed loop of the card clothing to expand circumferentially as the closed loop is slid over the guide onto the carrier cylinder.

4. An assembly for carding fibres, comprising:

a carrier cylinder having a slot in an outer surface of the carrier cylinder;

a card clothing including (i) an elongate strip of resilient material having opposed ends which abut one another when the card clothing is wrapped around the carrier cylinder, (ii) wire carding teeth carried by the elongate strip of resilient material, and projecting from one side thereof so as to form a substantially uniform distribution of carding teeth throughout the outer surface of the carrier cylinder, and (iii) an elongate formable into a closed loop carrier web secured to the elongate strip and having opposed ends which each project longitudinally beyond a respective end of the elongate strip; and an elongate U-shaped clip which is defined when viewed in cross-section by a pair of leg portions and a base portion from which the leg portions depend, the elongate U-shaped clip being located in the slot in the carrier cylinder with the base portion thereof extending along the slot, the card clothing being formed into a closed loop with the opposed ends of the elongate strip of resilient material abutting one another and the opposed ends of the carrier web projecting inwardly of the closed loop alongside one another, the carrier web being formable so as to be wrapped around the carrier cylinder, the ends of the carrier web being located in the slot in the carrier cylinder and engaged between the leg portions of the elongate U-shaped clip so that the clip fixes the card clothing onto the outer surface of the carrier cylinder.

* * * * *